United States Patent [19]

Rayner et al.

[11] Patent Number: 4,577,776

[45] Date of Patent: Mar. 25, 1986

[54] CONTAINERS AND LEVER RING

[75] Inventors: Adrien P. Rayner, Iver; Kenneth R. Clark, Standlake, both of England

[73] Assignee: Metal Box Plc, Berkshire, England

[21] Appl. No.: 675,315

[22] Filed: Nov. 27, 1984

[30] Foreign Application Priority Data

Dec. 2, 1983 [GB] United Kingdom ..... 8332287

[51] Int. Cl.[4] ..... B65D 41/16

[52] U.S. Cl. ..... 220/307; 220/306; 220/90; 229/5.5

[58] Field of Search ..... 220/307, 254, 85 R, 220/90, 90.6, 353, 354, 306; 229/5.5; 215/274

[56] References Cited

U.S. PATENT DOCUMENTS

| | | | |
|---|---|---|---|
| 1,879,517 | 9/1932 | Rowbotham | 220/85 R |
| 2,873,052 | 2/1959 | Atherton | 220/90 X |
| 2,873,881 | 2/1959 | Nichols | 220/90 |
| 3,874,580 | 4/1975 | Weatherhead | 229/5.5 |
| 4,356,930 | 11/1982 | Roper | 220/306 |

FOREIGN PATENT DOCUMENTS

| | | | |
|---|---|---|---|
| 1362620 | 4/1964 | France | 220/90 |

*Primary Examiner*—Steven M. Pollard

*Attorney, Agent, or Firm*—Burns, Doane, Swecker & Mathis

[57] ABSTRACT

A lever lidded container has a lever ring moulded from plastics material to comprise an annular flange engaged with the container body, and a frustoconical portion extending radially and axially in relation to the annular flange, towards the interior of the container, to support a cylindrical receiving portion which engages with the plug portion of a lever lid. The container body may be moulded from plastics material or formed from sheet metal.

14 Claims, 14 Drawing Figures

CONTAINERS AND LEVER RING

BACKGROUND OF THE INVENTION

1. Field of the Invention

This invention relates to lever lid containers and more particularly but not exclusively to a lever ring attachable to the container body and adapted to receive a plug lid which may be progressively levered out of the ring to open the container.

2. Description of the Prior Art

Lever lid tins have been used by the paint trade for many years. They are usually made of tinplate and comprise a body having a bottom end; a cylindrical side wall having a side seam which may be a folded and soldered side seam or a lap welded side seam; and a lever ring which is attached to the top of the side wall by a double seam. The plug portion of a lever lid is frictionally held in the ring.

The water based paints now widely used have subjected the tinplate lever ring to a much greater risk of corrosion especially at the worked surfaces and cut edges of the ring disposed inside the container headspace. It is therefore desirable to provide a lever ring which can survive the corrosive environment in the container.

Conventional tinplate lever rings comprise an annular cover hook for double seaming, a chuck wall depending from the interior of the cover hook, a folded portion supporting a flared portion extending from the chuck wall radially and axially back concentrically within the chuck wall to a second fold portion from which depends a cylindrical lid receiving portion. The flared portion thus holds any lid fitted up at a level substantially flush with the top of the container body giving a neat appearance and access for insertion of a lever used to remove the lid from the ring.

However this arrangement of the flared portion presents a possibility that the axially applied forces used to push the lid into the ring will crush the flared portion, so closing the aperture defined by the lid receiving portion and making it more difficult to fit the lid. If the closed container is subjected to abuse, of the kind which is tested by the usual drop tests, the hydraulic pressure within the container acts on the lid which in turn passes the hydraulic force on to the flared portion which may yield beyond its intended shock absorbing flexure to permit the lid to be forced out of the ring.

SUMMARY OF THE INVENTION

This invention provides a lever ring for a container body and adapted to receive a plug lid, wherein the ring is moulded from a plastics material and comprises an annular flange engageable with an interior surface of the container body, a flared portion and a ring portion adapted to receive, when in use, a plug portion of a plug lid, said flared portion extending from one end of the annular flange radially and axially into the ring portion. The annular flange may be round, rectilinear or of other shapes complementary to the side wall to which it is to be fitted. In each case the flared portion permits easy entry of the plug portion of a lid and thereafter firm retention of the lid.

The annular flange preferably has a first annulus engageable with the interior surface of the container body, a second annulus in spaced relationship within the first annulus and a plurality of webs joining the first annulus to the second annulus. This composite annular flange has structural rigidity to survive top and side loading.

The flared portion may be frustoconical and extends radially and axially into the annular flange at a preferred angle of approximately 60° to the axis of the lever ring.

A collar portion may surround the annular flange in order to prevent the annular flange being pushed entirely into the container body.

In one embodiment the ring portion is a hollow cylinder and extends in a direction parallel to the axis of the lever ring to each side of the inner periphery of the flared portion. The hollow cylinder may have an outwardly flaring mouth surface to assist entry of the plug lid into the cylindrical surface.

In another embodiment the ring portion comprises a cylindrical flange of internal diameter to permit easy entry of the plug portion of the lid and a throat portion of internal diameter adapted to seal with the plug portion of the lid.

In a further embodiment the annular flange is substantially rectilinear in outline to fit within the complementary arrangement of side walls of a container body.

When the lever ring has a round annular flange, drive receiving means, such as drive pegs upstanding from the flared surface, may be provided to permit spin welding. An annular projection may depend from the collar portion, to surround the annular flange for engagement with the side wall of the container by spin welding.

If desired, a lug portion may depend from the collar to support a pivot head extending laterally of the lug to permit fixing of a handle to the lever ring.

In another aspect the invention provides a lever ring as hereinbefore described with a lid having a flange outside the ring portion; a plug portion extending from the inner periphery of the flange through the ring portion; an annular bead of the plug portion snap fitted against the interior of the ring portion; and a closure panel spanning the plug portion.

In a further aspect the invention provides the lever rings as hereinbefore described when adhered to a metal side wall of a container body or alternatively spin welded to a side wall of plastics material.

DETAILED DESCRIPTION OF THE INVENTION

Figure 1:
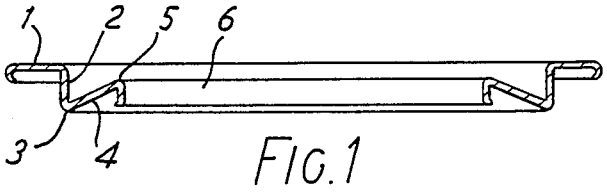
FIG. 1 is a side view in cross section on a diameter of a prior art tinplate lever ring.

In FIG. 1 the prior art lever ring comprises an annular cover hook 1 for double seaming to a container body (not shown). A chuck wall 2 depends from the inner periphery of the cover hook 1 and extends to a folded portion 3 which supports a flared portion 4 extending from the folded portion 3 radially and axially in a generally upward direction as shown to a second fold portion 5 from which depends a cylindrical lid receiving portion 6. Whilst the tinplate ring is relatively rigid during the forcing of a plug lid into the lid receiving portion 6 there would be a risk that if such a ring were made of plastics material any flexure of the flared portion 4 will tighten the lid receiving portion onto the plug lid because the flared portion is retained against outward spread by the material of the container body. Any hydraulic pressure developed by abuse of a filled container is liable to distend the flared portion 4 so loosening the lid.

Figure 2:
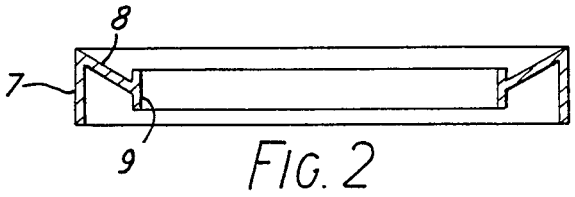
FIG. 2 is a side view in cross section on a diameter of a first embodiment of a lever ring according to this invention.

In FIG. 2, the first embodiment of a lever ring according to the invention is moulded from a plastics material to have an annular flange 7 engageable with the interior surface of a container. A substantially frustoconical portion 8 extends from one end of the annular flange 7 radially and axially in relation to the flange to support a cylindrical portion 9. The cylindrical portion 9 is adapted to receive when in use a plug portion of a plug lid. In contrast to FIG. 1 the flared portion of the substantially frustoconical portion of FIG. 2 extends downwardly as shown so that during fitting of a lid, such as is shown in FIG. 3, any elastic yielding of the frustoconical shape assists entry of the plug portion of the lid into the cylindrical portion 9.

Figure 3:
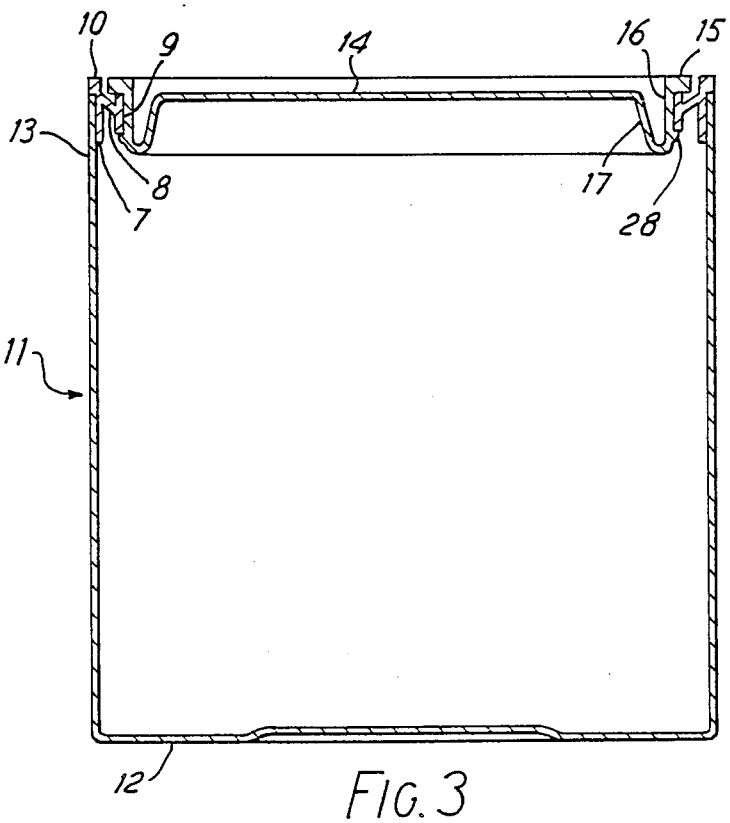
FIG. 3 is a side view in cross section of a second embodiment of the lever ring when fitted on a container with the lid fitted.

In FIG. 3 a second embodiment of the lever ring is depicted which has a collar portion 10 which abuts the end of the container body 11 to prevent the lever ring entering entirely into the container body. The rest of the lever ring of FIG. 3 operates in exactly the same way as the lever ring of FIG. 2 so like parts are indicated by the same numbers.

In FIG. 3 the container depicted is a plastics moulding comprising a bottom wall 12 and a side wall 13 upstanding from the periphery of the bottom wall. The annular flange 7 of the lever ring is a sliding fit in the mouth of the side wall 11 and abutment of the collar portion 10 with the end of the side wall 11 ensures that the annular flange is squarely entered into engagement with the body. This arrangement ensures that any adhesive used to attach the lever ring to the body is only subjected to a shear stress. This is advantageous because adhesives are usually stronger in the shear mode of stressing than in other modes such as uniaxial tension or peeling. Various joining techniques may be used to achieve this benefit; for example solvent welding, pre-applied adhesives, spin welding, or ultrasonic welding if the container body is of a plastics material.

In FIG. 3 the collar portion 10 is spin welded to the end of the side wall 11, the annular flange 7 serving to locate the plastics lever ring in the side wall 11 during spinning to effect the weld. Alternatively such a lever ring may be fixed to a side wall of a container by spin welding by a spin weld between the annular flange 7 and the interior of the side wall so that the bond created is, when in use, in the preferred shear mode of stress and not subject to an undesirable peeling mode of stress.

If the container body is metallic, adhesive bonding or spin welding may still be used but it may be found necessary to apply a primer coating of plastics material to the metal to be adhered to the annular flange. The primer coatings may be in the form of proprietary adhesion promotors. Alternatively metal prelaminated with plastics film or lacquer may be used so that the joint is effected by a process akin to heat sealing.

The adhesive bond of plastics ring to container body, may if desired, be augmented by providing snap-fit means on ring and body.

In FIG. 3 the lid 14 comprises a flange 15, a plug portion 16 dependent from the inner periphery of the flange and a dished closure panel 17. The plug portion 16 is provided with a bead 28 which snap fits under the cylindrical portion 9 of the lever ring. It will be readily understood that any hydraulic pressure generated by abuse of a filled container will exert an opening force on the lid 14. The engagement of the bead 18 and plug portion 16 with the cylindrical portion will transmit this hydraulic force into the frustoconical portion 8 which may bulge and thereby absorb the shock load. However any bulging of the frustoconical portion will impose a compressive hoop force on the cylindrical portion 9 so that the plug portion of the lid is gripped more tightly.

However the usual progressive use of a lever at several points under the flange of the lid against the collar 10 as fulcrum permits removal of the lid from the lever ring.

Figure 4:
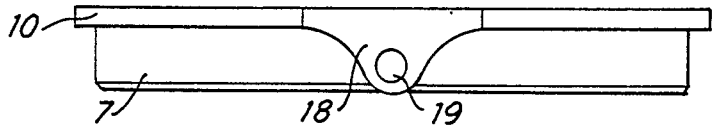
FIG. 4 is a side view of a third embodiment of a lever ring according to the invention.
Figure 5:
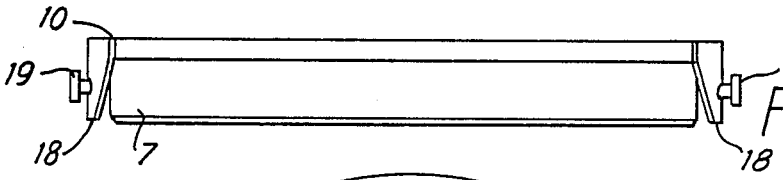
FIG. 5 is a front view of the embodiment of FIG. 4.
Figure 6:
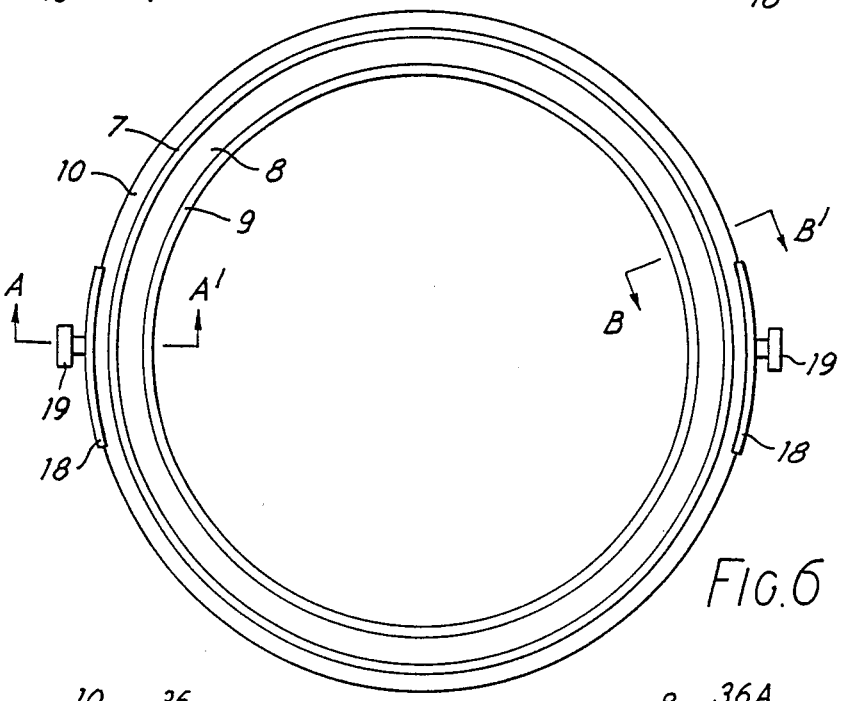
FIG. 6 is an under plan view of the lever ring of FIG. 4.

FIGS. 4 to 6 generally depict a preferred embodiment of the lever ring from the collar 10 of which depend a pair of lugs 18 which support a pair of diametrically opposed pivots 19 which permit attachment of a handle to the lever ring. Whilst the pivots are desirable on the larger sizes of paint containers they are not essential on smaller sizes of container.

Figure 7:
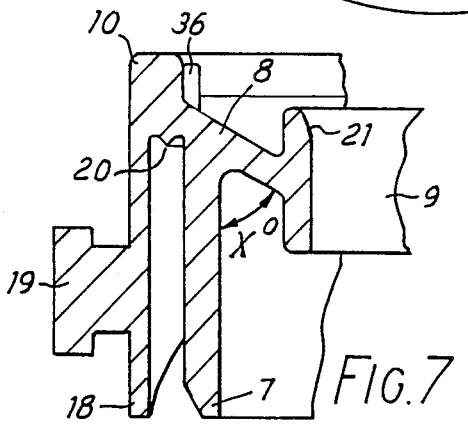
FIG. 7 is a fragmentary section on line A—A′ in FIG. 6.
Figure 8:
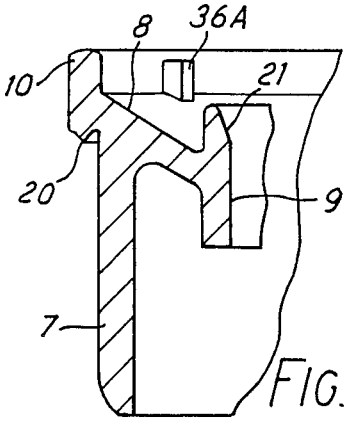
FIG. 8 is a fragmentary section on line B—B′ in FIG. 6.

The lever ring depicted in FIGS. 4 to 8 functions in like manner to the lever rings of FIGS. 2 and 3 so like parts are indicated with the same numbers previously used, namely the collar 10, from which depends the annular flange 7; the frustoconical portion 8 which extends downwardy and inwardy of the annular flange 7; and the cylindrical portion 9 which is adapted to receive the plug portion of a lid. In FIGS. 7 and 8 the cylindrical portion 9 is provided with flared entry portion 21.

In FIG. 7 it will be seen that the frustoconical portion is inclined at an angle X° to the surface of the annular flange 7 therefore being also inclined at an angle of X° to the axis of the ring. Choice of the value of X, the angle of inclination, requires two considerations. If one requires the frustoconical portion 8 to act as a strut in compression against hydraulic shock loads, a more acute angle is desirable. If however one requires the frustoconical portion to act as a shock absorber by flexure, a less acute angle is required. As both considerations are desirable, we have found that an angle of $X=60°$ is a useful compromise giving rise to reasonable lid retention and adequate shock absorption for the hydraulic loads arising in standard drop tests.

In FIGS. 7 and 8 an annular projection 20 is depicted on the underside of the collar portion 10. This projection serves to provide plastics material for spin welding the plastics lever ring to the side wall of a container made of plastics material. The projection 20 is not apparent in FIG. 3 because it is flattened during welding.

In FIGS. 7 and 8 driving pegs 36, 36A are shown against which the driving force is applied to create the spin weld. These driving pegs are optional in the embodiment of FIG. 6 because the driving force could, if desired, be applied to the pivots 19 to cause spin welding. It will be understood by those in the art that various alternative means to receive the driving force could alternatively be provided such as slots in the collar portion 10. Also the projection 20 is optional if the plastics container body has a suitable profile on its free edge.

As it is customary for the side walls of plastics containers to be relatively thick and for the side walls of metal containers to be thinner, for example 0.25 mm it is possible to arrange for the projection to be of such a size that a metal body fits between the projection 20 and the annular flange 7 so that the lever ring of FIGS. 4 to 8 may be fitted to either a plastics body or alternatively a metal body.

Whilst a metal body may be of the built up kind having a folded side seam, it is desirable that the internal surface of the side wall of the body be smooth and continuous in order to facilitate bonding of the annular flange 7 to the side wall. Therefore the now available mash welded side seams are preferred.

Figure 9:
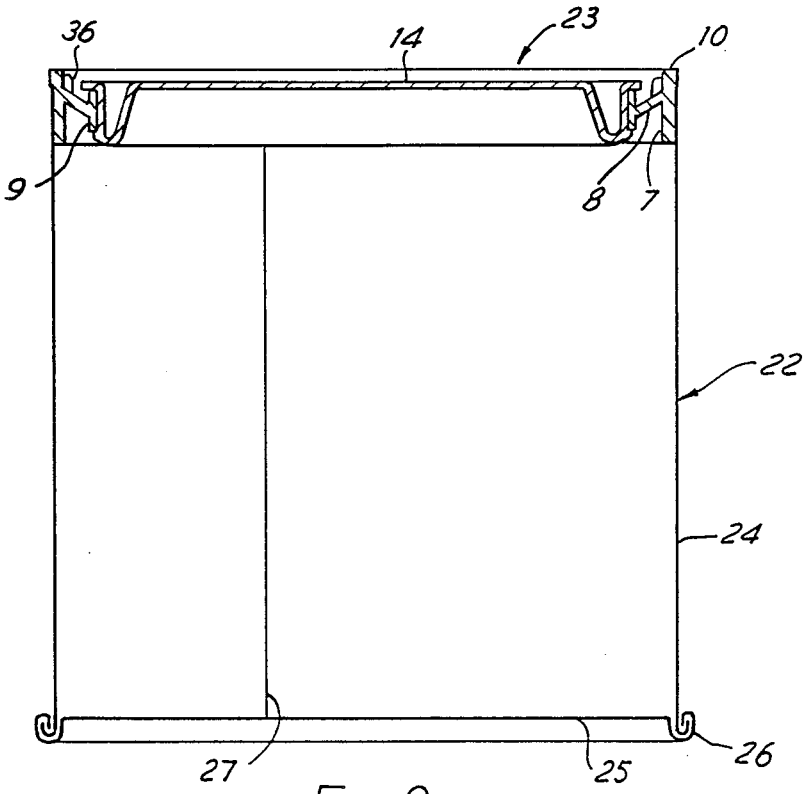
FIG. 9 is a side elevation of a round metal container sectioned on a diameter indicated as line C—C′ in FIG. 11.

FIG. 9 shows a can body 22 comprising a lid 14 and lever ring 23 of plastics materials such as polyethylene or polypropylene, a metal side wall 24 formed from tinplate or chromium/chromium oxide coated steel (known as TFS in the trade), and a bottom wall 25 of like metallic material joined to the side wall by a double seam 26. The metal side wall 24 is made by bending a sheet metal blank and joining the edges at a flattened weld 27 to make a cylinder with a smooth interior surface and a controlled girth. As the metal cylinder is flexible it is pulled to a good fit when the plastics lever ring 23 is inserted so that a good bond between ring and cylinder may be made by means of an adhesive. Alternatively the bond may be achieved by spin welding of the flange 7 of the lever ring on to a compatible coating (not shown) on the interior of the cylinder—for example a coating of polyethlyene may be used.

Figure 10:
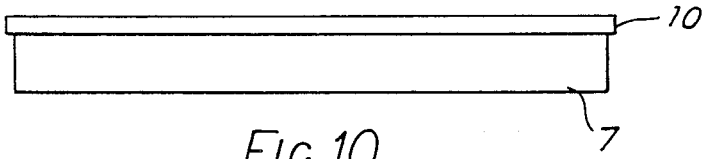
FIG. 10 is a side elevation of the lever ring shown in FIG. 9.

In FIG. 10 it will be seen that the collar portion 10 does not have an annual projection of material for spin welding as alreaqy described with reference to FIGS. 7 and 8. In the embodiment of FIG. 9 the annular flange 7 is bonded to the metal side wall 24 because the thickness of the metal side wall will usually be too thin to permit a joint between the collar portion 10 and the end edge of the metal side wall.

Figure 11:
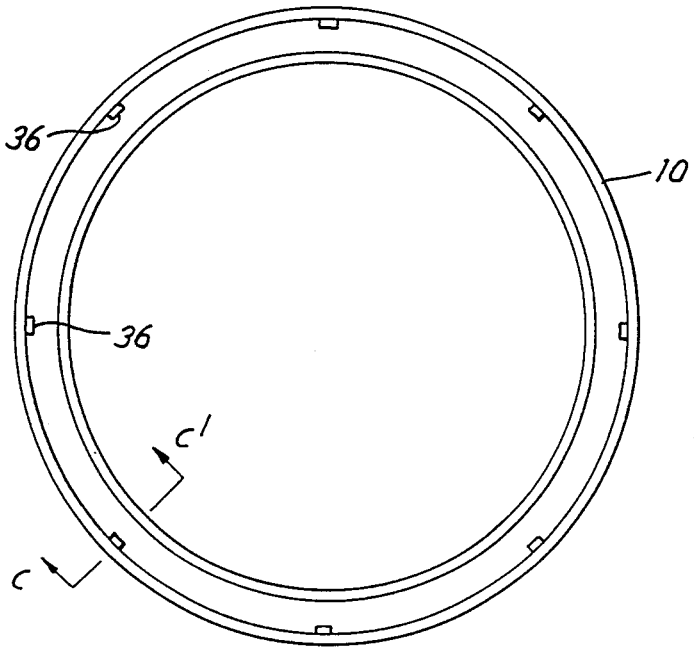
FIG. 11 is a plan view of the lever ring shown in FIGS. 9 and 10.

In FIG. 11 eight driving pegs, denoted 36, are shown arranged around the interior surface of collar portion 10 between the collar portion 10 and flared portion 8. The driving pegs are not big enough to spoil the desired flexure of the flared portion 8. Adequate space is provided between the driving pegs 36 to permit insertion of a lever at various positions between the flange of the lid and lever ring to effect progressive prising open of the lid. The driving pegs 36, or like functioning feature, are necessary. if the lever ring of FIGS. 9, 10 and 11 is to be spin welded to the body 22 but not essential if adhesives are used.

Figure 12:
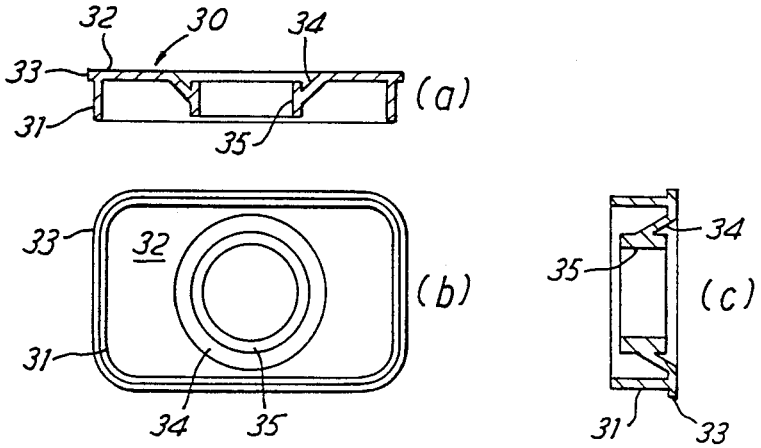
FIG. 12 (*a*) (*b*) and (*c*) respectively show sectioned side elevation, plan and sectioned end view of rectangular embodiment of the lever ring.

FIG. 12 shows a further embodiment of the lever ring 30 in which a rectangular flange 31 depends from a flat top panel 32 which overhangs the flange to define a collar portion 33 to limit the entry of the flange into a rectangular can body for bonding in a manner already described. A frustoconical portion 34, centred in the flat top panel 32, extends downwardly into the flange 31 to support a cylindrical portion 35 adapted to receive a lever lid such as has already been described.

Whilst lids having a snap fit bead are preferred because the bead increases the lid's ability to contain pressure within the container by passing hydraulic forces through the cylindrical portion to the frustoconical portion, lids having no snap fit bead may be used by relying on a tight plug fit engagement in the cylindrical portion if the anticipated pressure on the plug lid is not great.

Figure 13:
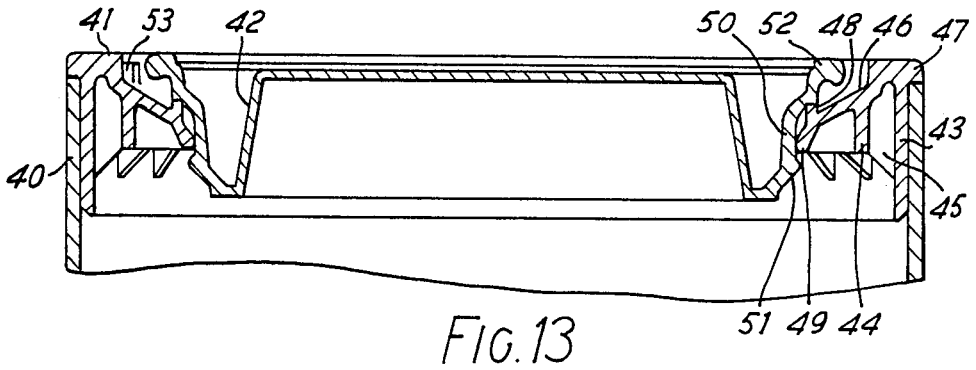
FIG. 13 is a side elevation of a part of a container fitted with a further embodiment of the ring and lid sectioned on a diameter.

FIG. 13 shows an upper part of a side wall 40 of a container made of plastics material. A lever ring 41, moulded from a polypropylene, is attached to the side wall 40. A plug lid 42 is fitted in the lever ring 41.

Figure 14:
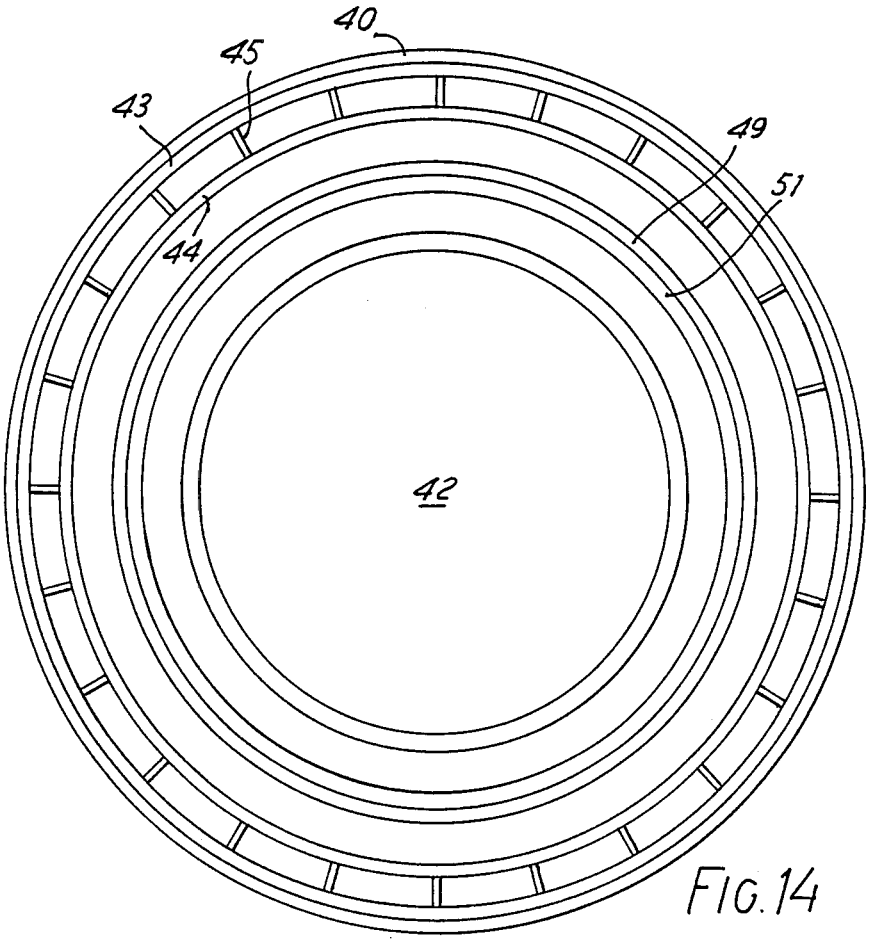
FIG. 14 is a plan view of the container ring and lid of FIG. 13.

The lever ring 41 comprises an alternative form of the annular flange having a first annulus 43 engaged with the side wall 40, a second annulus 44 in concentric spaced relationship within the first annulus 43, and a plurality of webs (one of which is denoted 45) joining the first annulus 43 to the second annulus 44, best seen in FIG. 14.

A flared portion 46 spans the webs 45 and extending from the end of the annular flange 43, which carries a collar 47, radially and axially in relation to the annular flange to support a ring portion engaged with the lid 42. The ring portion comprises a cylindrical flange 48 upstanding from the inner periphery of the flared portion 46 and a throat portion 49 extending below the flared portion to seal against the plug portion 50 and abut a lateral bead 51 of the plug lid 42.

The lid 42 has a flange 52 at the top of the plug portion 50 so that the lid is held firmly against motion in a vertical direction (as shown in FIG. 13) by engagement of flange 52 and cylindrical flange 48 and by engagement of lateral bead 51 and throat portion 49. The hoop shape and size of throat portion 49 define a sealing surface engaged with the plug portion 50 of lid 42. This ring portion may be somewhat easier to open than the embodiment shown in FIGS. 3 and 9.

Referring to FIG. 14, it will be understood that the combination of first annulus 43, second annulus 44 and webs 45 provides an annular flange of sufficient rigidity to survive top and side load forces.

Whilst a plurality of pegs, such as that denoted 53, may be used to deliver the spin welding motion, various other drive receiving means may be used such as slots moulded in the top surface of the lever ring.

Whilst the invention has been described in terms of round or rectangular container bodies, lever rings using the principles described may be made for containers of various irregular shapes such as are used for decorated tins and boxes used in the biscuit, tea and confectionery trades. For instance, octagonal and square tins are commonly used.

Whilst lever rings moulded from polyethylene or polypropylene are desirable for economy, rings may be moulded from other materials. For example Nylon 6 could be used for rings fixed to containers for solvent based paints which attack polypropylene or polyethylene.

We claim:

1. A lever ring for a container body and adapted to receive a plug lid removable from the ring by means of a lever, wherein the ring is moulded from a plastics material and comprises an annular flange adapted to fit in an open upper end of the container body and to engage with the interior surface of the container body, a flared portion and a ring portion adapted to receive and grip, when in use, a plug portion of a plug lid, said flared portion extending from the upper end of the annular flange radially and axially into the ring portion in the downward direction inwardly of the container body, whereby said flared portion permits easy entry of the plug portion of the plug lid and thereafter firm retention of the lid.

2. A lever ring according to claim 1, wherein the annular flange has a first annulus engageable with the interior surface of the container body, a second annulus in spaced relationship within the first annulus and a plurality of webs joining the first annulus to the second annulus.

3. A lever ring according to claim 1, wherein the flared portion is frustoconical and extends radially and axially into the annular flange at an angle of approximately 60° to the axis of the lever ring.

4. A lever ring according to claim 1, wherein a collar portion surrounds the annular flange and serves to prevent the annular flange being pushed entirely into the container body.

5. A lever ring according to claim 4, wherein a lug portion depends from the collar and a pivot head extends laterally of the lug to permit fixing of a handle to the lever ring.

6. A lever ring according to claim 1, wherein the ring portion is a hollow cylinder and extends in a direction parallel to the axis of the lever ring to each side of the inner periphery of the flared portion.

7. A lever ring according to claim 6, wherein the hollow cylinder has an outwardy flaring mouth surface to assist entry of the plug lid into the cylindrical surface.

8. A lever ring according to claim 1, wherein the annular flange is substantially rectilinear in outline to fit within the complementary arrangement of side walls of a container body.

9. A lever ring according to claim 1, wherein drive receiving means of the ring permit spin welding.

10. A lever ring according to claim 9, wherein an annular projection depends from the collar portion, to surround the annular flange, for engagement with the side wall of the container by spin welding.

11. A lever ring according to claim 1 wherein the ring portion comprises a cylindrical flange of internal diameter to permit easy entry of the plug portion of the lid and a throat portion of internal diameter adapted to seal with the plug portion of the lid.

12. A lever ring according to claim 1, when fitted with a lid having a flange outside the ring portion, a plug portion extending from the inner periphery of the flange through the ring portion, an annular bead of the plug portion snap fitted against the interior of the ring portion, and a closure panel spanning the plug portion.

13. A lever ring according to claim 1, when adhered to the metal side wall of a container body.

14. A lever ring according to claim 1, when attached to a side wall of plastics material of a container body.

* * * * *